United States Patent [19]

Forte

[11] 4,261,071

[45] Apr. 14, 1981

[54] SHOE TREE

[75] Inventor: Robert M. Forte, Millbury, Mass.

[73] Assignee: Polly Products, Co., Inc., Millbury, Mass.

[21] Appl. No.: 61,479

[22] Filed: Jul. 27, 1979

[51] Int. Cl.[3] ..... A43D 5/00

[52] U.S. Cl. ..... 12/115.6

[58] Field of Search ..... 12/115.6, 115.8, 128 R, 12/128 B, 114.4

[56] References Cited

U.S. PATENT DOCUMENTS

| | | | |
|---|---|---|---|
| 2,903,725 | 9/1959 | Zeserson et al. | 12/115.6 |
| 3,193,861 | 7/1965 | Howard | 12/115.8 |
| 3,239,860 | 3/1966 | Iredale | 12/115.8 |

*Primary Examiner*—Patrick D. Lawson

*Attorney, Agent, or Firm*—Norman S. Blodgett; Gerry A. Blodgett

[57] ABSTRACT

Shoe tree which has been blow-molded from an elastomer plastic and having a hollow bellows existing between a toe piece and a heel piece.

3 Claims, 6 Drawing Figures

SHOE TREE

BACKGROUND OF THE INVENTION

It is common knowledge that it is a desirable situation to own a large number of pairs of shoes and to use any one pair only occasionally. In this way, a particular pair of shoes has an opportunity to recover from its use and to retain its original shape. At the same time it is desirable to provide each pair of shoes with an individual shoe tree to help it to retain its shape. However, where a large number of shoes is owned, it is very expensive to provide a separate pair of shoe trees for each pair of shoes. This because in the past shoe trees have been made as solid blocks of wood, so far as the toe piece and heel piece are concerned, joined by a screw or toggle mechanism made of metal. This wood and metal construction is very expensive, so that few people are able to afford to provide shoe trees for all of their shoes. Attempts in the past to manufacture inexpensive shoe trees have been less than successful, partly because of the difficulty of providing a simple means of providing the longitudinal force between the toe piece and the heel piece to retain the shoe in proper condition. Furthermore, shoe trees of the prior art have been less than sanitary in use and, after washing, had to be thoroughly dried to prevent deterioration. These and other difficulties experienced with the prior art devices have been obviated in a novel manner by the present invention.

It is, therefore, an outstanding object of the invention to provide a shoe tree which is inexpensive to manufacture and sell.

Another object of this invention is the provision of a shoe tree which is light in weight and which provides a gentle shoe-shape retaining force.

A further object of the present invention is the provision of a shoe tree which is capable of a long life of useful service with a minimum of maintenance.

It is another object of the instant invention to provide a shoe tree which is sanitary in use and which can readily be washed without danger of deterioration of the materials.

With these and other objects in view, as will be apparent to those skilled in the art, the invention resides in the combination of parts set forth in the specification and covered by the claims appended hereto.

SUMMARY OF THE INVENTION

In general, the invention consists of a shoe tree having a toe piece, a heel piece, and an elongated bellows joining the toe piece to the heel piece. The bellows is capable of substantial lengthwise compression and expansion and also is capable of twisting to provide constant pressure on the surfaces of the shoe and to compensate for variations in the shoe size and shape.

More specifically, the toe piece, bellows, and heel piece are formed as an integral hollow element formed of an elastomer plastic. Indentations are provided on both sides of the heel piece to assist in removing the shoe tree from a shoe.

BRIEF DESCRIPTION OF THE DRAWINGS

The character of the invention, however, may be best understood be reference to one of its structural forms, as illustrated by the accompanying drawings, in which.

DESCRIPTION OF THE PREFERRED EMBODIMENT

Figure 1:
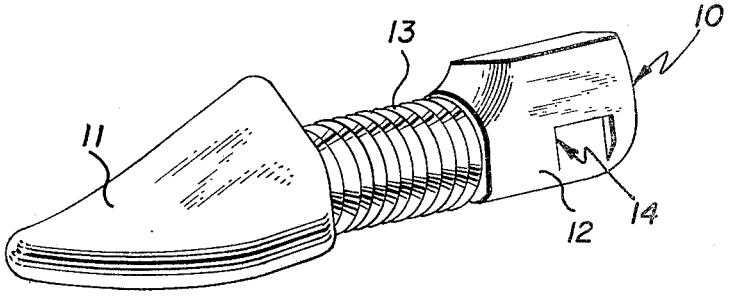
FIG. 1 is a perspective view of a shoe tree embodying the principles of the present invention.
Figure 2:
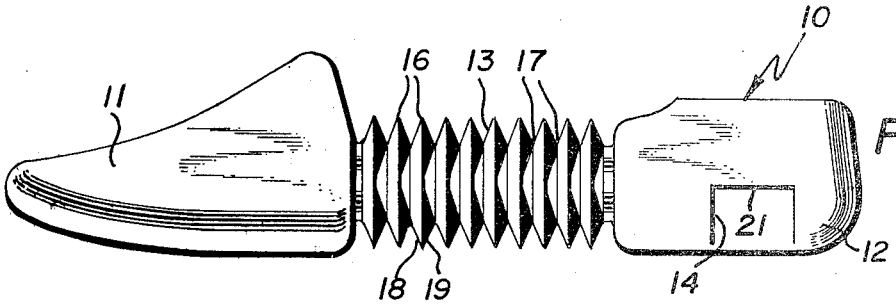
FIG. 2 is a side elevational view of the shoe tree.
Figure 3:
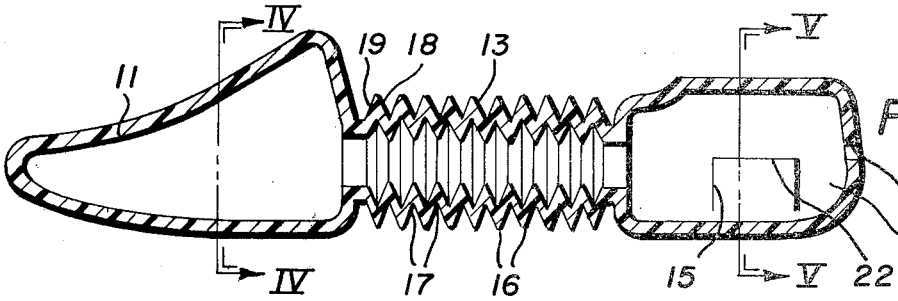
FIG. 3 is a longitudinal sectional view of the shoe tree taken on the line III—III of FIG. 4.
Figure 4:
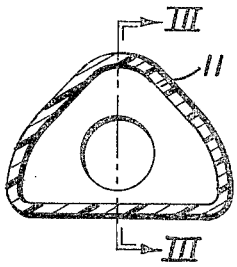
FIG. 4 is a transverse sectional view of the shoe tree taken on the line IV—IV of FIG. 3.

Referring first to FIG. 1, wherein are best shown the general features of the invention, it can be seen that the shoe tree, indicated generally by the reference numeral 10, consists of a toe piece 11 and a heel piece 112 joined by an elongated bellows 13. The toe piece is adapted to fit into the toe portion of a shoe, while the heel piece is adapted to fit into the rear or heel portion of the shoe. The bellows 13 joins the toe piece 11 to the heel piece 12 and is capable of substantial lengthwise compression and expansion. It is also capable of twisting about a longitudinal axis to provide constant pressure on the inner surfaces of the shoe and to compensate for variations in the size and shape of shoes.

Referring to FIGS. 2, 3, 4, and 5, which show the details of the invention, it can be seen that the bellows 13 is integrally formed of an elastomer plastic. The heel piece 12 is provided with indentations 14 and 15 on either side to assist in removing the shoe tree from a shoe. As is particularly evident in FIG. 3, the toe piece 11, the bellows 13, and the heel piece 12 are formed as an integral hollow element formed of an elastomer plastic. In the preferred embodiment, they are formed by the blow-molding process in which a tubular parison of warm, soft plastic is extruded and then is clamped between two formed mold halves, after which air pressure is introduced into the interior of the parison to blow the plastic against the surfaces of the mold cavity to form the article.

Figure 5:
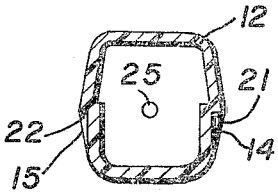
FIG. 5 is a transverse sectional view of the shoe tree taken on the line V—V of FIG. 3.

The bellows 13 is formed as a hollow corrugated member of plastic with large diameter portions 16 and small diameter portions 17 alternately arranged. As is evident in FIG. 3, each corrugation has an outer surface consisting of two opposed frusto-conical surfaces. Referring particularly to FIG. 5, it can be seen that each of the indentations 14 and 15 is provided with a longitudinal downwardly-facing shelf 21 and 22, respectively, located midway between the top and the bottom of the heel piece.

Figure 6:
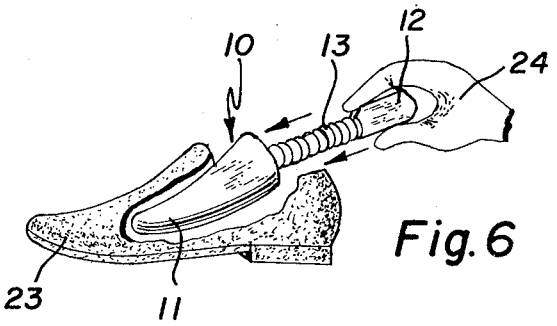
FIG. 6 is a schematic view showing the use of a shoe tree with a shoe.

The operation and the advantages of the present invention will now be readily understood in view of the above description. The shoe tree is used in a more less conventional manner, as shown in FIG. 6. The toe piece 11 is inserted into the shoe 23 by grasping the heel piece 12 in the hand 24 of the user. When the toe piece has been slid into the shoe as far as is reasonably possible, the user continues to press with his hand 24 against the rear surface of the heel piece 12, thus compressing the bellows 13. The heel piece is then inserted into the shoe, so that its rear surface engages the inner surface of the heel of the shoe. In compressing the bellows 13, the air is expelled through a small aperture 25 formed in the heel piece 12. When the user releases the heel piece, the bellows expands and presses the heel piece 12 against the rear of the shoe. This produces a longitudinal force between the toe piece and the heel piece that causes them to press against the inner surfaces of the shoe in a gentle manner. It has long been recognized that the proper care of shoes does not require a strong force between the toe and the heel, but only a gentle, steady force that acts on the shoe over a long period of time to make it conform to its original shape. As a matter of fact, a strong force that is generally thought to be necessary has the effect of tearing the inner lining of the shoe and distorting the shape of the shoe in an undesirable manner. In order to remove the present shoe tree from the shoe, it is only necessary to reach inside, to place the fingers in the indentations 14 and 15, and to pull up against the shelves 21 and 22. Because the heel piece 12 is formed somewhat narrower than the shoe, there is a space between the side surfaces of the heel portion of the shoe and the side surfaces of the heel piece 12 that makes it possible for the user to slip his fingers down and into the indentations. It is a simple matter to keep the shoe tree clean by simply removing it, placing it in soap and water, and washing it as though it were a dish. It is, therefore, possible to maintain the shoe tree in a sanitary condition; this could be particularly important where shoe trees would be used by different members of the same family.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Shoe tree, comprising:

(a) a toe piece, (b) a heel piece provided with an indentation on each side of the heel piece consisting of a longitudinal downwardly-facing shelf located midway between the top and the bottom of the heel piece to assist in removing the shoe tree from a shoe, and (c) an elongated bellows joining the toe piece to the heel piece, the bellows being capable of substantial lengthwise compression and expansion and of twisting to provide constant pressure on the surface of the shoe and to compensate for variations in shoe size and shape.

2. Shoe tree as recited in claim 1, wherein the bellows is integrally formed of an elastomer plastic.

3. Shoe tree as recited in claim 1, wherein the toe piece, bellows, and heel piece are formed as an integral hollow element of an elastomer plastic.

* * * * *